United States Patent [19]

Shibata et al.

[11] 3,977,442

[45] Aug. 31, 1976

[54] FLUID PRESSURE CONTROL DEVICE FOR SHUTTLELESS WEAVING LOOM

[75] Inventors: Kazuo Shibata, Sagamihara; Seiji Kasai, Tokyo, both of Japan

[73] Assignee: Nissan Motor Co., Ltd., Japan

[22] Filed: Apr. 3, 1975

[21] Appl. No.: 564,663

[30] Foreign Application Priority Data

Apr. 9, 1974 Japan ..... 49-40187
Sept. 30, 1974 Japan ..... 49-112425

[52] U.S. Cl. ..... 139/435
[51] Int. Cl.[2] ..... D03D 47/30
[58] Field of Search ..... 139/127 P, 127 R, 144; 226/97, 99; 239/410, 411

[56] References Cited

UNITED STATES PATENTS

| | | | |
|---|---|---|---|
| 2,668,560 | 2/1954 | Svaty | 139/127 P |
| 3,114,396 | 12/1963 | Bardsley et al. | 139/144 |
| 3,828,829 | 8/1974 | Gotoh | 139/127 P |

FOREIGN PATENTS OR APPLICATIONS

| | | | |
|---|---|---|---|
| 35,388 | 6/1967 | Japan | 139/127 P |

*Primary Examiner*—Henry S. Jaudon
*Attorney, Agent, or Firm*—Robert E. Burns; Emmanuel J. Lobato; Bruce L. Adams

[57] ABSTRACT

A device for controlling the fluid pressure to be imparted to a jet stream of fluid to entrain a weft yarn to be picked into the shed of warp yarns in a weft inserting arrangement of a shuttleless weaving loom, comprising flow restriction means and pressure accumulating means provided intermediate a source of fluid under pressure and a fluid discharge nozzle from which the jet stream of fluid is to be shot. The flow restriction means and the pressure accumulating means are arranged in such a manner that the supplied fluid pressure is accumulated to a certain quantity during a period intervening between consecutive two picking cycles and supplied during each picking cycle to the nozzle at a rate which is gradually decreased towards the end of the picking cycle so that the weft yarn is picked at a velocity that gradually diminishes as the pick of the yarn shot from one end of the shed approaches the other end of the shed.

16 Claims, 11 Drawing Figures

FLUID PRESSURE CONTROL DEVICE FOR SHUTTLELESS WEAVING LOOM

BACKGROUND OF THE DISCLOSURE

The present invention relates in general to an automatic weaving loom of the shuttleless type and particularly to a shuttleless weaving loom having a weft inserting arrangement in which a measured length of weft yarn is cyclically picked into a shed of warp yarns by means of a jet stream of fluid which is shot from a nozzle into the shed of the warp yarns in predetermined cycles. More specifically, the present invention is concerned with a device for producing such a jet stream of fluid in the weft inserting arrangement of the specific nature.

As is well known in the art of shuttleless weaving looms, the behaviour of the weft yarn picked into the shed of warp yarns by means of a jet stream of fluid varies markedly depending upon the fluid pressure developed in the nozzle from which the weft yarn is to be shot and the duration of the cycle during which the fluid is discharged from the nozzle. It is, for this reason, desirable to have these parameters varied in consideration of the nature of the weft yarns used and the width of the woven fabric to be produced. If, for example, a spun yarn is used as the weft yarn and water is used as the medium to entrain the pick of the weft yarn, it is required that the pressure imparted to the stream of water to be shot from the nozzle be continuously varied as the time lapses during each picking cycle because the behaviour of the picks of spun yarns in general is more seriously affected by the stream of water than those of other types of yarns such as, for example, filament yarns and should be entrained on a greater volume of water stream than the water streams used to pick the filament yarns.

If the pressure imparted to the fluid to be discharged from the nozzle is maintained constant throughout each of the picking cycles, the pick of the weft yarn shot from the vicinity of one end of the shed of the warp yarns will be gradually decelerated as the forward end of the weft yarn approaches the opposite end of the shed by reason of the resistance of air to the jet stream of water entraining the weft yarn. The velocity of the weft yarn end reaching the opposite end of the shed of the warp yarns thus becomes lower by several per cent than the initial velocity of the weft yarn shot from the nozzle and, accordingly, the pick of the weft yarn being inserted through the shed of the warp yarns is higher in velocity in its portion close to one end of the shed than its portion close to the opposite end of the shed. The weft yarn therefore tends to be slackened when received by the warp yarns forming the shed so that not only irregularity is created in the tension of the weft yarn forming a woven fabric but it happens that the weft yarn has a loop formed in its intermediate portion, giving rise to deterioration of the commercial value of the fabric produced. It is, for this reason, desirable in shooting the jet steam of fluid from the nozzle to have the velocity of the jet stream continuously diminished during each of the weft picking cycles so that the pick of the weft yarn is propelled at a lower velocity toward the end of each picking cycle than at an initial stage of the picking cycle. The velocity of the jet stream of fluid ejected from the nozzle is substantially in direct proportion to the pressure imparted to the fluid which is about to be discharged from the nozzle if the nozzle has a fixed area at its outlet end. The velocity of the jet stream of fluid from the nozzle may therefore be controlled by gradually reducing the fluid pressure to be developed in the nozzle. To achieve this end, it will be necessary to impart a higher pressure than usual to the jet stream of fluid to be discharged from the nozzle at an incipient stage of the picking cycle so that the weft yarn inserted through the shed of warp yarns is sufficiently taut throughout its length covering the entire width of the shed in each picking cycle.

SUMMARY OF THE INVENTION

It is, accordingly, an important object of the present invention to provide a device for continuously reducing the pressure of fluid to be shot into the shed of warp yarns in each picking cycle of a shuttleless weaving loom of the described nature.

It is another important object of the present invention to provide a device which is adapted to impart a higher pressure than usual to the fluid to be shot into the shed of warp yarns at an incipient stage of each picking cycle and to thereafter continuously reduce the fluid pressure until the weft yarn entrained on the jet stream of fluid has properly reached the end of the shed opposite to the end of the shed close to the nozzle of the weft inserting arrangement of a shuttleless weaving loom of the described nature.

To achieve these objects, it has been proposed to use as a fluid supply source for the weft inserting arrangement of the described character a plunger pump provided with spring means which is so preloaded as to produce the increased fluid pressure at an incipient stage of each picking cycle and which is so arranged as to be capable of continuously reducing the fluid pressure delivered from the pump during each picking cycle. In view, however, of the fact that usually a number of looms are operated concurrently in one production plant with the weft inserting arrangements connected to a common fluid supply source or plunger pump and that the performance characteristics usually vary from one loom to another, a problem will arise in that the fluid pressure delivered from the plunger pump could not be regulated in such a manner as to be optimum for all the weaving looms unless the individual looms are respectively provided with pumps which are designed to match the performance characteristics of the respective looms. Provision of fluid supply sources respectively associated with a number of looms would, however, result in a extremely increased production cost and require an extremely increased space for the accommodation of the whole production equipment and is, thus, objectionable from an economical point of view.

It is, therefore, still another important object of the present invention to provide a device for controlling the fluid pressure to be developed in the weft inserting arrangement of one weaving loom independently of the fluid pressure to be developed in the weft inserting arrangement of another weaving loom connected to a fluid supply source which is common to the former.

It is still another important object of the present invention to provide a simple and economical device adapted to improve the commercial value of a fabric produced by a shuttleless weaving loom of the described character.

In accordance with the present invention, the above mentioned object will be accomplished basically in a device which comprises fluid supply means for continuously supplying fluid under pressure at a constant rate, a fluid discharge nozzle disposed in a weft inserting arrangement for discharging the fluid to be shot into the shed of warp yarns, passageway means interconnecting the fluid supply means and the fluid discharge nozzle, valve means disposed in the passageway means and having a first condition providing communication between the fluid supply means and the fluid discharge nozzle and a second condition blocking the communication therebetween, control means associated with the valve means for actuating the valve means into the first condition thereof in cycles synchronized with predetermined picking cycles of the weft inserting arrangement, hydropneumatic pressure accumulating means disposed in the passageway means upstream of the valve means for accumulating therein the pressure of the fluid from the fluid supply means when the valve means is in the second condition thereof and delivering the accumulated fluid pressure to the fluid discharge nozzle through the valve means when the valve means is in the first condition thereof, and flow restriction means disposed in the passageway means upstream of the pressure accumulating means for restricting the flow of the fluid from the fluid supply means to the pressure accumulating means. The control means associated with the valve means may comprise electromagnetic actuating means mechanically connected to the valve means and adapted to be energized in the cycles synchronized with the picking cycles of the weft inserting arrangement for actuating the valve means, the actuating means being operative to actuate the valve means into the first condition thereof when energized, and resilient biasing means urging the valve means toward the second condition thereof so that the valve means is urged into the second condition when the actuating means is de-energized. As an alternative, the control means may comprise a rotary cam member which is rotatable at a velocity synchronized with the picking cycles of the weft inserting arrangement, cam follower means engaging on one hand with the cam member and on the other hand with the valve means for being intermittently driven by the cam member into a position moving the valve means into the first condition thereof in cycles synchronized with the picking cycles of the weft inserting arrangement, and resilient biasing means associated with the cam follower means for urging the cam follower means toward a position to move the valve means into the second condition thereof.

The device according to the present invention may further comprise second flow restriction means disposed in the passageway means between the valve means and the fluid discharge nozzle for restricting the flow of the fluid from the valve means to the nozzle when the valve means is in the first condition thereof. The second flow restriction means is preferably releasable from the passageway means so that the flow restriction characteristics achieved between the valve means and the fluid discharge nozzle can be varied depending upon the performance characteristics of the loom on which the device is to be mounted. If desired, the first named flow restriction means may also be arranged to be releasable from the passageway means so that the flow restriction characteristics achieved between the particular flow restriction means and the pressure accumulating means can be varied for substantially the same reason.

BRIEF DESCRIPTION OF THE DRAWINGS

The features and advantages of the device according to the present invention will become more apparent from the following description taken in conjunction with the accompanying drawings in which.

DESCRIPTION OF THE PREFERRED EMBODIMENT

Figure 1:
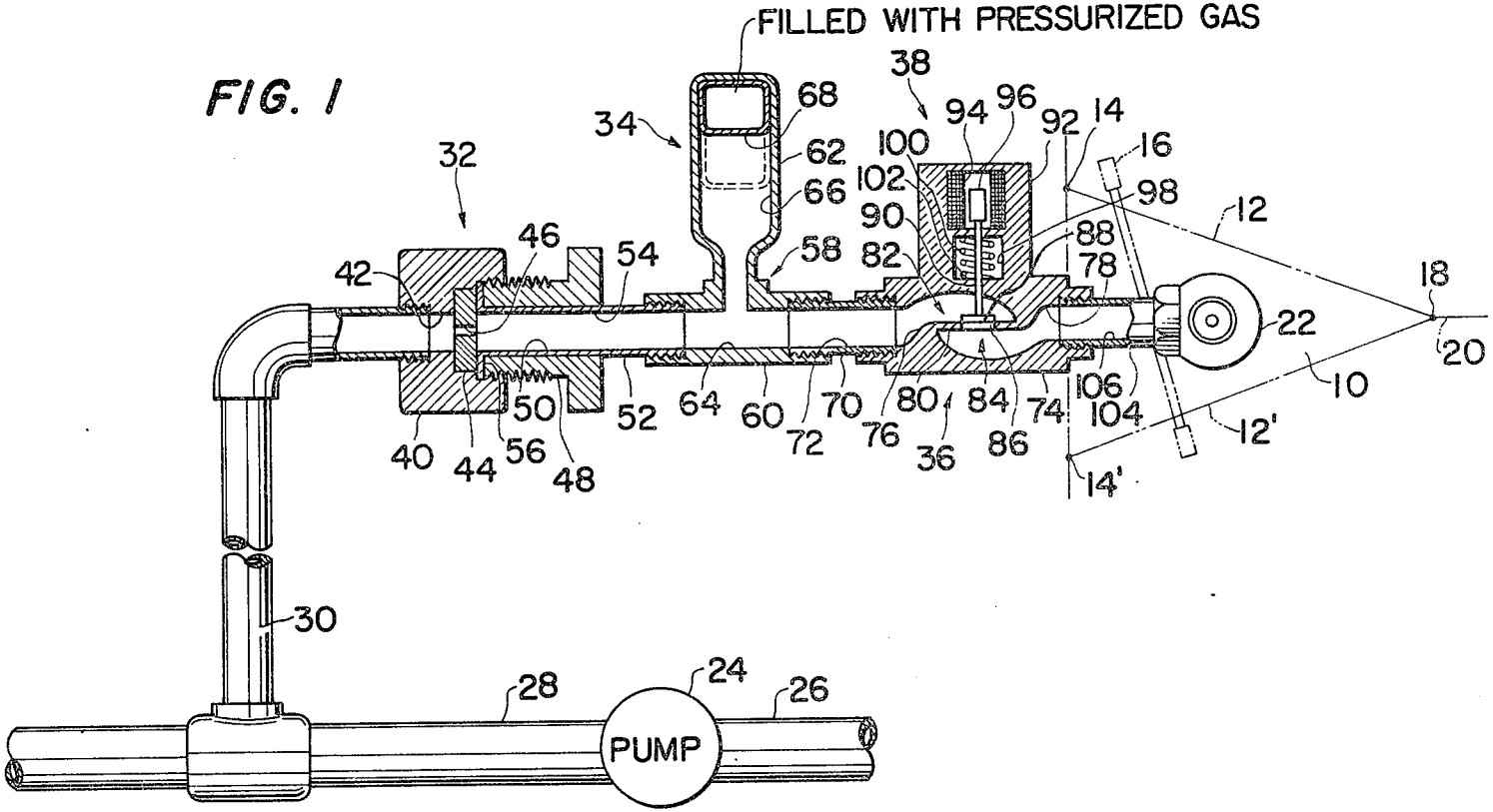
FIG. 1 is a view, mostly in longitudinal section, of a first preferred embodiment of the device according to the present invention.

Referring now to the drawings, first to FIG. 1, the device embodying the present invention is incorporated into a shuttleless loom having a weft inserting arrangement by which a measured length of weft yarn (not shown) supplied from a yarn package (not shown) is cyclically picked into a shed 10 of warp yarns which consist of two sets of warp yarns 12 and 12' which are angularly spaced by a number of eyed healds 14 and 14'. The pick of the weft yarn thus inserted through the shed 10 of the warp yarns 12 and 12' is beaten by a reed 16 onto the cloth fell 18 of a woven fabric 20. The construction and operation of the weft inserting mechanism of this nature is well known in the art of textile production and is rather immaterial to the understanding of the gist of the present invention, no further description regarding details thereof will be herein incorporated.

The weft yarn is picked into the shed 10 of the angularly spaced sets of warp yarns 14 and 14' by means of a jet stream of fluid which is discharged under pressure from a fluid discharge nozzle 22 which is shown as having an axis normal to the plane of the drawing on which FIG. 1 is mounted. The fluid is supplied to the fluid discharge nozzle 22 from a constant-displacement fluid feed pump 24 which has a suction port (not shown) leading through a fluid supply pipe 26 from a fluid reservoir (not shown) in which fluid such as water is stored. The pump 24 is herein associated with a number of shuttleless weaving looms which may have similar or different performance characteristics and, thus, has a discharge port (not shown) connected to a fluid distribution pipe 28 from which a number of branch pipes extend although only one of the branch pipes is shown as at 30 in FIG. 1. If it is desired for some reason that the pump 24 be associated with only one loom, the suction port of the pump 24 may be connected direct to the pipe 30.

The branch pipe 30 thus leading from the fluid distribution pipe 28 is connected to the fluid discharge nozzle 22 through a flow restriction unit 32, a hydropneumatic pressure accumulator unit 34 and a valve unit 36 in this sequence. The valve unit 36 is associated with an electromagnetic control unit 38 which is operated in cycles which are synchronized with the picking cycles of the weft inserting arrangement as will be described later.

The flow restriction unit 32 is constructed to restrict the flow of the fluid from the branch pipe 30 to the pressure accumulator unit 34 and includes a casing 40 which is formed with a central bore 42. The casing 40 has fixedly mounted therein a disc member 44 formed with an orifice 46 communicating with the bore 42 in the casing 40. The casing 40 is screwed at one longitudinal end to the leading end portion of the branch pipe 30 so that the pipe 30 is open into the bore 42 and communicates through the bore 42 with the orifice 46 in the disc member 44 and at the other longitudinal end to a clamp member 48 which has a longitudinal bore 50 substantially aligned with the central bore 42 in the casing 40. The clamp member 48 is fixedly received in its longitudinal bore 42 a tubular member 52 which has a longitudinal passageway 54 extending throughout the length of the tubular member 52 and a flange portion 56 formed at one longitudinal end of the tubular member. The flange portion 56 of the tubular member 52 is closely interposed between the disc member 44 and the inner longitudinal end of the clamp member 48 so that the disc member 44 is fixedly held in a position providing constant communication between the central bore 42 in the casing 40 and the longitudinal passageway 54 in the tubular member 52 through the orifice 46 in the disc member 46. The tubular member 52 projects outwardly from the outer longitudinal end of the clamp member 48 for being connected to the hydropneumatic pressure accumulator unit 34 which is located downstream of the flow restriction unit 32 thus constructed.

The hydropneumatic pressure accumulating unit 34 is adapted to accumulate therein the pressure of the fluid directed thereto from the flow restriction unit 32 when the valve unit 36 is held in a condition to block the communication between the pressure accumulator unit 34 and the fluid discharge nozzle 22 and to deliver the accumulated fluid pressure to the fluid discharge nozzle 22 when the valve unit 36 is actuated from the above mentioned condition into a condition providing the communication between the pressure accumulator unit 34 and the fluid discharge nozzle 22. The pressure accumulator 34 thus functioning includes a casing 58 which consists of a generally tubular portion 60 and a container portion 62 which is integral with the tubular portion 60 and which is shown to project perpendicularly from the tubular portion 60. The tubular portion 60 is formed with a longitudinal passageway 64 which is open at both ends whereas the container portion 62 is formed with a pressure accumulating chamber 66 which is in constant communication with the passageway 64 in the tubular portion 60. Within the pressure accumulating chamber 66 is positioned a flexible confinement or bag 68 which is flexible between a contracted condition indicated by full lines and an expanded condition indicated by broken lines depending upon relationship between the pressures developed inside and outside the bag 68. The tubular portion 60 of the casing 58 thus arranged is screwed or otherwise securely connected at one end to a leading end portion of the tubular member 52 projecting from the clamp member 48 of the flow restriction unit 32 and at the other end to a tubular member 70 which is formed with a longitudinal passageway 72. The longitudinal passageway 54 in the tubular member 52 connected to one end of the tubular portion 60 of the casing 58 and the longitudinal passageway 72 in the tubular member 70 connected to the other end of the tubular portion 60 of the casing 58 are, thus, in constant communication with each other through the longitudinal passageway 64 in the tubular portion 60 of the casing 58. If, as is well known in the art, the passageway 64 in the tubular portion 60 of the casing 58 is closed at its downstream end close to the tubular member 70 (or, actually, the valve unit 36 located downstream of the passageway 64 is actuated into the condition blocking the communication between the passageway 64 and the fluid discharge nozzle 22) and a fluid pressure is directed into the pressure accumulating chamber 66 through the upstream end of the passageway 64, the fluid pressure thus admitted into the pressure accumulating chamber 66 acts against the pressurized gas inside the bag 68 and forces the bag 68 to be compressed until the pressure inside and outside the bag 68 are equalized. The flexible bag 68 is consequently contracted into the condition indicated by full lines and, as a consequence, a certain quantity of fluid pressure is accumulated in the pressure accumulating chamber 66 depending upon the volume of contraction of the bag 68. If the passageway 64 in the tubular portion 60 is thereafter opened (or, actually, the valve unit 36 is actuated into the condition establishing communication between the passageway 64 and the fluid discharge nozzle 22), the fluid pressure which has been accumulated in the pressure accumulating chamber 66 is released therefrom and simultaneously the gas pressure inside the bag 68 acts against the fluid pressure in the chamber 66 until the bag 68 is expanded to the condition indicated by the broken lines. The fluid pressure delivered from the pressure accumulating chamber 66 thus gradually diminishes until the pressure is equalized with the fluid pressure delivered from the flow restriction unit 32. The pressure accumulator incorporated into the embodiment shown in FIG. 1 has been assumed to be of the type using a gas-filled bag but, if desired, such an accumulator may be replaced with any other type of hydropneumatically operated pressure accumulator of, for example, the direct air-and-water contact type or the piston type. As an alternative to the hydropneumatic pressure accumulator, an accumulator of the spring-loaded or weight-loaded type may be utilized if preferred.

The valve unit 36 associated with the electromagnetic control unit 38 is located downstream of the pressure accumulator unit thus constructed and arranged. The valve unit 36 includes a casing 74 formed with fluid inlet and outlet ports 76 and 78 and a valve chamber intermediate the fluid inlet and outlet ports 76 and 78. The casing 74 has a valve seat portion 80 which divides the valve chamber into an upstream section 82 merging out of the fluid inlet port 76 and a downstream section 84 merging into the fluid outlet port 78. The valve seat portion 80 of the casing 74 is formed with an opening 86 through which communication may be provided between the upstream and downstream sections 82 and 84 of the valve chamber and accordingly between the fluid inlet and outlet ports 76 and 78. Within the upstream section 82 of the valve chamber is positioned a valve member 88 which is arranged to be movable between a first position unseated from the valve seat portion 80 for providing communication between the upstream and downstream sections 82 and 84 through the opening 86 in the valve seat portion 80 and a second position blocking the communication between the sections 82 and 84 of the valve chamber. The valve member 88 is carried by a valve actuating rod 90 which extends through the upstream section 82 of the valve chamber in the casing 74 and which is longitudinally movably connected to the electromagnetic control unit 38 which is adapted to move the valve member 88 through the valve actuating rod 90 in accordance with predetermined schedules, viz., in cycles which are synchronized with the picking cycles of the weft inserting arrangement.

The control unit 38 includes a casing 92 which is fixedly mounted on or, as illustrated, integral with the casing 74 of the valve unit 36 and has installed in the casing 92 a solenoid device consisting of a solenoid coil 94 wound in a cylindrical configuration and a movable core 96 surrounded by the solenoid coil 94 and axially movable over a predetermined stroke. The solenoid coil 94 is connected to a suitable electric control circuit (not shown) and is energized under the control of such a circuit in cycles which are synchronized with the cycles in which the measured length of weft yarn is picked into the shed 10 of the warp yarns 12 and 12' during operation of the weaving loom, as will be discussed in more detail. The movable core 96 is connected to the valve actuating rod 90 so that the valve member 88 carried by the actuating rod 90 is moved between the previously defined first and second positions thereof as the movable core 96 is moved back and forth in the casing 92. The solenoid device is assumed to be operative to move the core 96 and accordingly the valve actuating rod 90 in a direction to move the valve member 88 into the previously mentioned first position seated from the valve seat portion 80 of the casing 74 and thus providing communication between the upstream and downstream sections 82 and 84 of the valve chamber through the opening 86 in the valve seat portion 80 when the solenoid coil 94 is energized. The casing 92 is formed with a chamber 98 in which is positioned a preload spring 100 which is seated on a spring seat member 102 fixed to the valve actuating rod 90 and is arranged to urge the actuating rod 90 in a direction to move the valve member 88 into the previously mentioned second position closing the opening 86 in the valve seat portion 80 of the casing 74 and accordingly blocking communication between the upstream and downstream sections 82 and 84 of the valve chamber in the casing 74.

The casing 74 of the valve unit 36 is screwed or otherwise securely connected at its end portion forming the fluid inlet port 76 to the leading end portion of the tubular member 70 projecting from the pressure accumulator unit 34 so that the longitudinal passageway 72 in the tubular member 70 is in constant communication with the fluid inlet port 76 and accordingly the upstream section 82 of the valve chamber in the casing 74 of the valve unit 36. The casing 74 of the valve unit 36 is further connected at its end forming the fluid outlet port 78 to one end portion of a tubular member 104 which is, in turn, connected at the other end portion to the fluid discharge nozzle 22. The tubular member 104 thus interconnecting the valve unit 36 and the fluid discharge nozzle 22 is formed with a longitudinal passageway 106 which communicates at one end with the fluid outlet port 78 in the casing 74 of the valve unit 36 and at the other end with the fluid discharge nozzle 22. A continuous passageway is, in this manner, constantly established from the discharge port (not shown) of the fluid feed pump 24 to the upstream section 82 of the valve chamber in the casing 74 of the valve unit 36 through the fluid distribution pipe 28, the branch pipe 30, the central bore 42 in the casing 40 of the flow restriction unit 32, the orifice 46 in the disc member 44 mounted on the casing 40, the longitudinal passageway 54 in the tubular member 52 interconnecting the flow restriction unit 32 and the pressure accumulator unit 34, the longitudinal passageway 64 in the tubular portion 60 of the casing 58 of the pressure accumulator unit 34, the longitudinal passageway 72 in the tubular member 70 interconnecting the pressure accumulator unit 34 and the valve unit 36, and the fluid inlet port 76 in the casing 74 of the valve unit 36. Another passageway is constantly established from the downstream section 84 of the valve chamber in the casing 74 of the valve unit 36 to the fluid discharge nozzle 22 through the fluid outlet port 78 in the casing 74 and the longitudinal passageway 106 in the tubular member 104 interconnecting the valve unit 36 and the fluid discharge nozzle 22. The passageways thus provided between the distribution pipe 28 and the fluid discharge nozzle 22 are assumed to have substantially equal and uniform cross sectional areas except for the central bore 42 in the disc member 44 of the flow restriction unit 32 and, possibly, the upstream and downstream sections 82 and 84 of the valve chamber in the casing 74 of the valve unit 36, as will be seen from FIG. 1.

During operation, the constant-displacement fluid feed pump 24 sucks in fluid from the fluid reservoir (not shown) storing, for example, water through the fluid supply pipe 26 and delivers fluid under pressure to the fluid distribution pipe 28 at a constant rate. As previously noted, the fluid distribution pipe 28 is common to the weft inserting arrangements of a number of weaving looms each of which is equipped with the device of the general nature illustrated in FIG. 1, although only one of such devices is herein shown for the sake of simplicity of illustration. The fluid under pressure thus delivered to the fluid distribution pipe 28 is distributed to the branch pipe 30 associated with the weft inserting arrangement of each of the weaving looms and is directed through the branch pipe 30 into the central bore 42 in the casing 40 of the flow restriction unit 32 in which the branch pipe 30 terminates. The pressurized fluid is then passed through the orifice 46 in the disc member 44 at a rate restricted by the orifice 46 and is directed, in part, to the upstream section 82 of the valve chamber in the valve unit 36 through the passageway 54 in the tubular member 52, the passageway 64 in the tubular portion 60 of the casing 58 of the pressure accumulator 34, the passageway 72 in the tubular member 70 and the fluid inlet port 76 in the casing 74 of the valve unit 36 and, in part, to the pressure accumulating chamber 66 in the accumulator unit 34. If, under these conditions, the solenoid coil 94 of the valve control unit 38 is energized responsive to the picking cycle in the weft inserting arrangement of the weaving loom, the movable core 96 of the control unit 38 and, accordingly, the valve actuating rod 90 connected to the movable core 96 are moved against the opposing force of the preload spring 100 in a direction to move the valve member 88 away from the valve seat portion 80 of the casing 74 of the valve unit 36, thereby holding the valve member 88 in the previously mentioned first position providing communication between the upstream and downstream sections 82 and 84 of the valve chamber in the casing 74 through the opening 86 in the valve seat portion 80 of the casing 74. The pressurized fluid which has been directed to the upstream section 82 of the valve chamber is consequently allowed to reach the fluid discharge nozzle 22 through the opening 86 in the valve seat portion 80, the downstream section 84 of the valve chamber and the fluid outlet port 78 in the casing 74 of the valve unit 36 and the passageway 106 in the tubular member 104 interconnecting the valve unit 36 and the fluid discharge nozzle 22. The solenoid coil 94 of the valve control unit 38 remains energized and, as a consequence, the communication kept established between the upstream and downstream sections 82 and 84 of the valve chamber in the valve unit 36 until the picking cycle in the weft inserting arrangement terminates. At the end of the picking cycle, the solenoid coil 94 of the valve control unit 38 is de-energized so that the movable core 96 of the valve control unit 38 and accordinly the valve actuating rod 88 of the valve unit 36 are moved by the action of the preload spring 100 in a direction to move the valve member 88 into the second position seated on the valve seat portion 80 of the casing 74 of the valve unit 36. The opening 86 in the valve seat portion 80 of the casing 74 is now closed by the valve member 88 so that the communication between the upstream and downstream sections 82 and 84 of the valve chamber in the casing 74 is interrupted, as will be seen from FIG. 1. The pressurized fluid which has been passed through the orifice 46 in the disc member 44 of the flow restriction unit 32 is therefore directed into the pressure accumulating chamber 66 of the container portion 62 of the casing 58 of the accumulator unit 34 by way of the longitudinal passageway 54 in the tubular member 52 and the passageway 64 in the tubular portion 60 of the casing 58. The pressurized fluid thus entering the pressure accumulating chamber 66 acts against the pressurized gas inside the gas-filled bag 68, which is accordingly contracted from its expanded condition shown by the broken lines until the pressures inside and outside the bag 68 are equalized. When equilibrium is thus achieved between the pressures inside and outside the bag 68 and the bag 68 is contracted into the condition indicated by the full lines in FIG. 1, a certain quantity of fluid pressure is accumulated in the pressure accumulating chamber 66, such a quantity depending upon the capacity of the container portion 62 and the mass of the gas with which the bag 68 is filled. If, under these conditions, the solenoid coil 94 of the valve control unit 38 is energized and accordingly the valve member 88 of the valve unit 36 is moved into the first position thereof in response to another picking cycle in the weft inserting arrangement, not only the pressurized fluid passed through the orifice 46 in the disc member 44 of the flow restriction unit 32 but the pressurized fluid which has been accumulated in the pressure accumulating chamber 66 of the accumulator unit 34 is applied to the fluid discharge nozzle 22 by way of the upstream and downstream sections 82 and 84 of the valve chamber in the valve unit 36 with the valve member 88 unseated from the valve seat portion 80 of the casing 74. As a consequence, the pressure of the fluid being discharged from the pressure accumulating chamber 66 is gradually diminished with the gas-filled bag 68 gradually expanded from the contracted condition indicated by the full lines. The quantity of the fluid passed through the flow restriction unit 32 is restricted by the orifice 46 in the disc member 44 of the unit 32 and is therefore smaller than the quantity of the fluid discharged from the pressure accumulating chamber 66. As the pressure of the fluid discharged from the accumulating chamber 66 is diminished however, the flow rate of the fluid passed through the flow restriction unit 32 gradually rises and, because of the fact that flow rate of fluid is in direct proportion to the pressure of the fluid, a gradually increasing fluid pressure is delivered from the flow restriction unit 32. The fluid discharge nozzle 22 is, in this manner, supplied with a gradually decreasing fluid pressure from the pressure accumulating chamber 66 of the accumulator unit 34 and a gradually increasing fluid pressure from the flow restriction unit 32 throughout the picking cycle of the weft inserting arrangement. Since, in this instance, the flow restriction unit 32 and the pressure accumulating unit 34 are so-arranged that the rate of decrease of the fluid pressure from the pressure accumulating chamber 66 is higher in absolute value than the rate of increase of the fluid pressure from the flow restriction unit 32, the fluid pressure developed in the fluid discharge nozzle 22 shows a decreasing tendency. When the picking cycle in the weft inserting arrangement terminates, the solenoid coil 94 of the valve control unit 38 is deenergized and accordingly the valve member 88 of the valve unit 36 is moved into the second position thereof closing the opening 86 in the valve seat portion 80 of the casing 74 so that the downstream section 82 of the valve chamber is isolated from the upstream section 82 of the valve chamber. The fluid pressure in the fluid discharge nozzle 22 is consequently dropped to a zero level and the fluid pressure passed through the flow restriction unit 32 is, for a second time, accumulated in the pressure accumulator unit 34.

Figure 2:
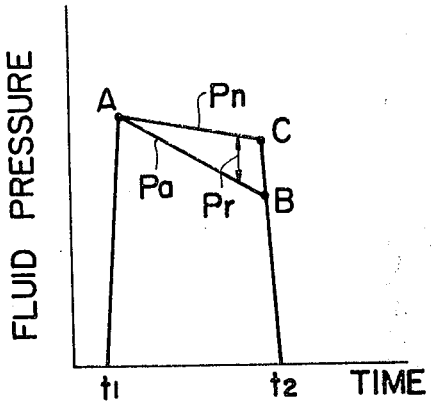
FIG. 2 is a graph which shows a general tendency of the performance characteristics achieved in the device illustrated in FIG. 1.

FIG. 2 illustrates a general tendency of the variation in the fluid pressure P*n* developed in the fluid discharge nozzle 22 in one cycle (between times $t_1$ and $t_2$) of the weft inserting arrangement as achieved by means of the device operating in the manners thus far described. Denoted by P*a* in FIG. 2 is the pressure of the fluid discharged from the pressure accumulating chamber 66 of the accumulator unit 34 and by P*r* is the pressure of the fluid which has been passed through the flow restriction unit 32. The pressure P*n* is, thus, the sum of the pressures P*a* and *Pr.* Immediately after the valve unit 36 is shifted from the closed condition to the open condition at time $t_1$, the fluid pressure abruptly rises in the fluid discharge nozzle 22 by reason of the fluid pressure discharged from the pressure accumulating chamber 66 of the accumulator unit 34 as indicated at point A in the graph of FIG. 1. The pressure P*a* of the fluid discharged from the pressure accumulating chamber 66 of the accumulator 34 diminishes as indicated by a downward ramp A–B towards time $t_2$ at which the picking cycle is to be terminated. To the fluid pressure P*a* thus decreasing from point A is added the fluid pressure P*r* delivered from the flow restriction unit 32. As previously mentioned, the pressure P*r* of the fluid from the flow restriction unit 32 is lower than the pressure P*a* of the fluid from the pressure accumulating chamber 66 of the accumulator unit 34 because of the flow of the fluid through the flow restriction unit 32 is restricted by the orifice 46 in the disc member 44 of the unit 32. Because, however, the fluid pressure P*r* from the flow restriction unit 32 increases as the fluid pressure P*a* from the pressure accumulating chamber 66 of the accumulator unit 34 diminishes and because the rate of increase of the fluid pressure P*r* is lower than the rate of decrease of the fluid pressure P*a*, the fluid pressure P*n* resulting from the fluid pressures P*a* and P*r* decreases at a rate which is lower than the rate of decrease of the fluid pressure P*a*, as will be seen from ramp A–C of the graph of FIG. 2. When the valve unit 36 shifted back from the open condition to the closed condition at time $t_2$, the fluid discharge nozzle 22 is isolated from both of the flow restriction unit 32 and the pressure accumulator 34 so that the fluid pressure therein abruptly drops to the zero level. The rate of decrease of the fluid pressure P*n* thus developed in the fluid discharge nozzle 22 can be selected by varying the rate of decrease of the fluid pressure P*a* and/or the rate of increase of the fluid pressure P*r* or, in other words, by varying the performance characteristics of the flow restriction unit 32 and/or the performance characteristics of the pressure accumulator unit 34.

Figure 3:
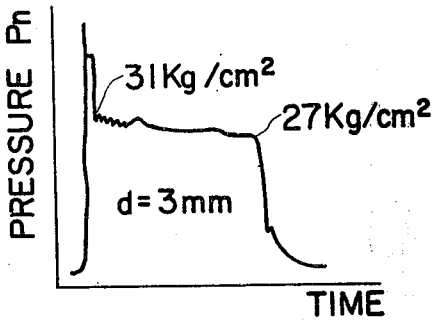
FIG. 3 is a graph showing an example of the variation of the fluid pressure achieved by the device illustrated in FIG. 1 during each of picking cycles.

It will now be appreciated from the foregoing description that the fluid discharge nozzle 22 is capable of producing a jet stream of fluid at a velocity which gradually decreases in direct proportion to the fluid pressure P*n* decreasing from point A to point C shown in FIG. 2 as the time lapses in each of the picking cycles of the weft inserting arrangement. FIG. 3 illustrates a curve indicative of the variation of the fluid pressure P*n* developed in the fluid discharge nozzle 22 in one picking cycle of the weft inserting arrangement when the disc member 44 provided in the flow restriction unit 32 is designed to have an orifice 46 measuring 3 mm in diameter and the pressure accumulator unit 34 designed to have a pressure accumulating chamber 66 having a total capacity of 100 m*l* and a bag 68 filled with a gas weighing 20 kgs/cm$^2$ and when fluid under pressure of 40 kgs/cm$^2$ is distributed to the branch pipe 30. As will be clearly seen from the curve of FIG. 3, the fluid pressure P*n* in the fluid discharge nozzle 22 is abruptly increased to 31.5 kgs/cm$^2$ immediately after the valve unit 36 is shifted from the closed condition to the open condition and is generally linearly decreased to 27 kgs/cm$^2$ toward the end the picking cycle.

Figure 4:
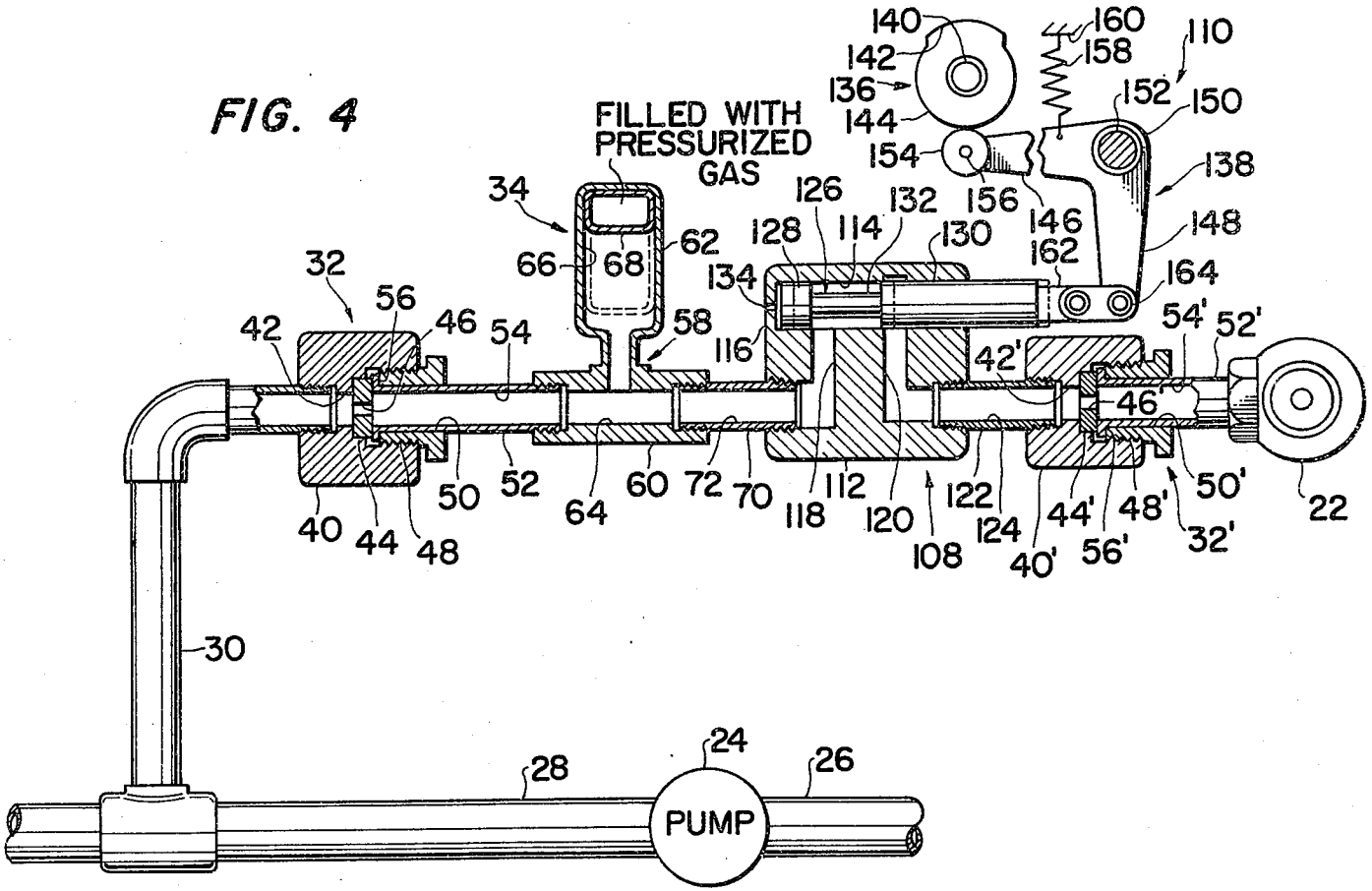
FIG. 4 is a view similar to FIG. 1 but shows a second preferred embodiment of the device according to the present invention.
Figure 6A:
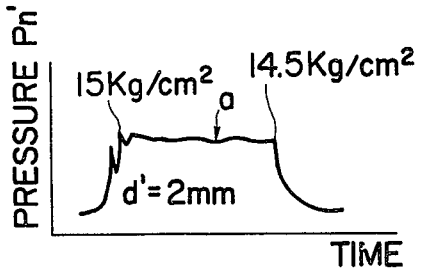
Figure 6B:
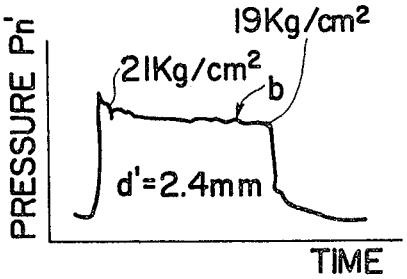
Figure 6C:
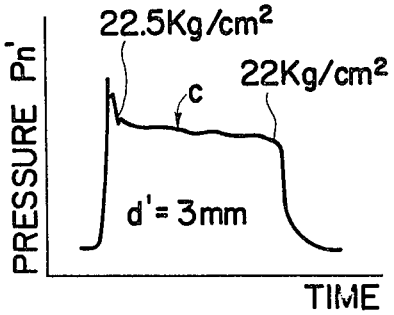
Figure 6D:
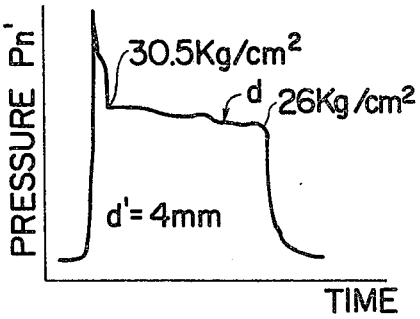
Figure 6E:
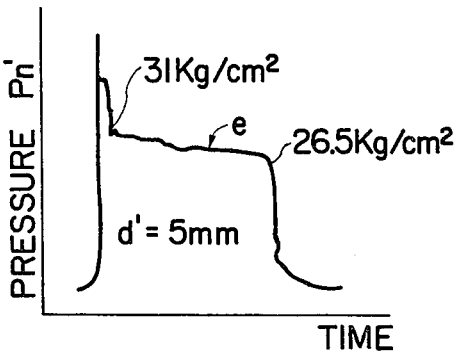
Figure 6F:
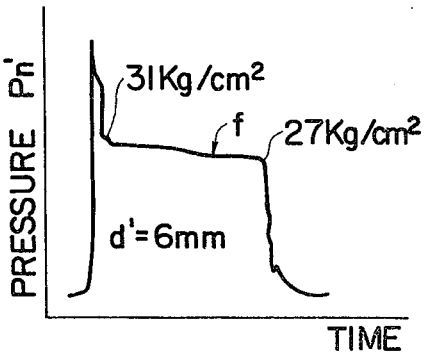

FIG. 4 illustrates a modification of the embodiment of the present invention shown in FIG. 1. In FIG. 4, members and units corresponding to those incorporated in the device shown in FIG. 1 are designated by like reference numerals. The embodiment shown in FIG. 4 is distinct over the embodiment of FIG. 1 in that, as alternatives to the valve unit 36 and the electromagnetic valve control unit 38 of the embodiment shown in FIG. 1, a valve unit 108 of the sliding spool directional flow type and a valve control unit 110 using a combination cam and cam-follower are used and that, in addition to the flow restriction unit 32, a second flow restriction unit 32′ is provided between the valve unit 108 and the fluid discharge nozzle 22. The pressure accumulator 34 provided in the embodiment shown in FIG. 4 is also assumed to be of the bag type, the same may be replaced with any other type of pressure accumulator as previously noted.

The valve unit 108 of the device shown in FIG. 4 includes a casing 112 which is formed with a cylindrical valve chamber 114 which is open at one end and closed at the other by a wall portion 116 of the casing 112. The casing 112 is further formed with fluid inlet and outlet ports 118 and 120 each of which is open at one end to the valve chamber 114. The previously mentioned tubular member 70 projecting from the downstream end of the tubular portion 60 of the casing 58 of the pressure accumulator unit 34 is screwed or otherwise securely connected to the casing 112 of the valve unit 108 in such a manner that the longitudinally passageway 72 in the tubular member 70 is in constant communication with the fluid inlet port 118 in the casing 112 of the valve unit 108. Likewise, a tubular member 122 having a longitudinal passageway 124 is screwed or otherwise releasably yet securely connected to the casing 112 of the valve unit 108 in such a manner that the fluid outlet port 120 in the casing 112 is in constant communication with the longitudinal passageway 124 in the tubular member 122. In the cylindrical valve chamber 114 in the casing 112 is longitudinally slidably received a spool valve member 126 which has first and second cylindrical lands 128 and 130 having substantially equal diameters and longitudinally spaced apart from each other to form a circumferential groove 132 therebetween. The spool valve member 126 is longitudinally movable in the valve chamber 114 between a first longitudinal position having the circumferential groove 132 located to communicate with both of the fluid inlet and outlet ports 118 and 120 as indicated by phantom lines in FIG. 4 and a second longitudinal position having the circumferential groove 132 to communicate only with the fluid inlet port 118 with the second cylindrical land 130 located to close the fluid outlet port 120 as indicated by full lines in FIG. 4. When the spool valve member 126 is held in the first longitudinal position indicated by the phantom lines, communication is established between the fluid inlet and outlet ports 118 and 120 through the circumferential groove 132 in the spool valve member 126 and, when the spool valve member 126 is held in the second longitudinal position indicated by the full lines, then the communication between the fluid inlet and outlet ports 118 and 120 is blocked by the second cylindrical land 130 of the valve member 126 closing the fluid outlet port 120. The previously mentioned wall portion 116 of the casing 112 is preferably formed with an air vent 134 for the purpose that air in the space between the inner face of the wall portion 116 and the end face of the first cylindrical land 128 of the spool valve member 126 be allowed to escape when the valve member 126 is moved closer to the wall portion 116 and the space above mentioned is reduced.

The valve control unit 110 predominant over the operation of the valve unit 108 thus constructed includes a rotary cam member 136 and a bell-crank lever 138 which serves as a cam follower. The cam member 136 is rotatable with a shaft 140 extending perpendicularly to the longitudinal axis of the spool valve member 126 of the valve unit 108 and has a lobe portion 142 which is radially raised from the remaining circumferential portion 144 of the cam member 136. The raised lobe portion 142 of the cam member 136 has a circumferential length corresponding to the duration of the picking cycle of the weft inserting arrangement (not shown) of a weaving loom and the remaining circumferential portion 144 has a length which corresponds to the time interval between the picking cycles. The cam member 136 is driven to rotate about the axis of the shaft 140 at a velocity which is synchronized with the picking cycles of the weft inserting arrangement and produces intermittent motions in cycles synchronized with the picking cycles. The bell-crank lever 138 serving as the follower for the cam member 136 consists of a pair of arm portions 146 and 148 which extend from a central fulcrum portion 150 and which are angularly spaced apart from each other about the fulcrum. The bell-crank lever 138 is rotatable on a shaft 152 extending in parallel with the shaft 140 for the cam member 136 and having an axis which is in line with the fulcrum of the lever 138. The bell-crank lever 138 has carried at the leading end of one arm portion 146 a roller 154 which is rotatable on a pin 156 fixed to the arm portion 146 and extending in parallel with the shaft 140 for the cam member 136. The bell-crank lever 138 is biased to hold the roller 154 in rolling contact with the cam member 136 by suitable biasing means which is shown to comprise a preload spring 158 connected at one end to the arm portion 146 of the lever 138 and at the other to a suitable stationary member 160. The previously mentioned second cylindrical land 130 of the spool valve member 126 has an end portion constantly projecting outwardly from the casing 112 of the valve unit 108 and is formed with an extension 162 projecting longitudinally from the outwardly projecting end of the cylindrical land 130. The bell-crank lever 138 of the valve unit 110 is pivotally connected to the extension 162 of the valve member 126 by a pivotal pin 164 so that the spool valve member 126 is longitudinally moved in either direction as the bell-crank lever 138 is driven to turn clockwise or counterclockwise of the drawing about the axis of the shaft 152. When, thus, the rotary cam member 136 is in an angular position having, its raised lobe portion 142 in rolling contact with the roller 154 on the arm portion 146 of the bell-crank lever 138 which is urged by the preload spring 158 to turn clockwise of the drawing about the axis of the shaft 152, the bell-crank lever 138 is held against the opposing force of the preload spring 158 in a first angular position holding the spool valve member 126 in the previously mentioned first longitudinal position providing communication between the fluid inlet and outlet ports 118 and 120 through the circumferential groove 132 in the spool valve member 126, as indicated by the phantom lines. When, however, the rotary cam member 136 is in an angular position having its radially sunk circumferential portion 144 in rolling contact with the roller 154 on the arm portion 146 of the bell-crank lever 138, then the bell-crank lever 138 is held by the action of the preload spring in a second angular position holding the spool valve member 126 in the previously mentioned second longitudinal position closing the fluid outlet port 120 by the second cylindrical land 130 of the valve member 126 and thus blocking the communication between the fluid inlet and outlet ports 118 and 120 of the valve unit 108. The rotary cam member 136 is driven to rotate about the axis of the shaft 140 at a velocity which is selected to have the raised lobe portion 142 intermittently brought into rolling contact with the roller 154 on the arm portion 146 of the bell-crank lever 138 in cycles which are substantially synchronized with the picking cycles of the weft inserting arrangement of the weaving loom. The bell-crank lever 138 is, thus, driven to rock about the axis of the shaft 152 between the above mentioned first and second angular positions thereof and accordingly the spool valve member 126 is reciprocated between the first and second longitudinal positions thereof in cycles which are in agreement with the picking cycles of the weft inserting arrangment of the weaving loom. Communication is thus provided between the fluid inlet and outlet ports 118 and 120 through the circumferential groove 132 of the spool valve member 126 in cycles synchronized with the picking cycles of the weft inserting arrangement. The combination of the valve unit 108 and the valve actuating unit 110 of the embodiment shown in FIG. 4 is, for this reason, essentially similar in effect to the valve unit 36 and the valve control unit 38 of the embodiment shown in FIG. 1.

The second flow restriction unit 32' provided in the embodiment illustrated in FIG. 4 is constructed essentially similarly to the first flow restriction unit 32 provided upstream of the pressure accumulator unit 34. The second flow restriction unit 32' thus comprises a casing 40' having a central bore 42', a disc member 44' received in the casing 40' and forward with an orifice 46' communicating with the central bore 42' in the casing 40', a clamp member 48' screwed or otherwise securely yet releasably connected to the casing 40' and having a longitudinal bore 50' substantially aligned with the central bore 42' in the casing 40', and a flanged tubular member 52' having a longitudinal passageway 54' and a flange 56' which is formed at one longitudinal end of the tubular member 52' as illustrated. The flanged tubular member 52' is fixedly received in the longitudinal bore 52' of the clamp member 48' in such a manner that the flange portion 56' thereof is closely interposed between the disc member 44' and the inner longitudinal end of the clamp member 48'. The disc member 44' is, thus, fixedly held in a position providing constant communication between the central bore 42' in the casing 40' and the longitudinal passageway 54' in the tubular member 52' through the orifice 46' in the disc member 44'. The disc member 44' is, however, removable and is thus exchangeable with a differently sized disc member when the clamp member 48' is released from the casing 40'. The casing 40' is screwed or otherwise securely yet releasably connected to the leading end portion of the previously mentioned tubular member 122 projecting from the casing 112 of the valve unit 108 in such a manner that the longitudinal passageway 124 in the tubular member 122 is in constant communication with the central bore 42' in the casing 40' and through the central bore 42' and the orifice 46' in the disc member 44' with the longitudinal passageway 54' in the tubular member 52' as shown. The tubular member 52' is connected at its leading end to the fluid discharge nozzle 22.

For the reason that will be understood as the description proceeds, it is preferable that the disc members 44 and 44' of the first and second flow restriction units 32 and 32', respectively, be so arranged that the orifice 46 formed in the disc member 44 of the first flow restriction unit 32 has a cross sectional area which is not larger than the cross sectional area of the orifice 46' in disc member 44' of the second flow restriction unit 32'. Furthermore, it may be noted that the passageways 124 and 54' in the tubular members 122 and 52' connected to the casing 40' of the second flow restriction unit 32' have cross sectional areas which are substantially equal to those of the previously mentioned tubular members 52 and 70 and the branch pipe 30.

As previously mentioned, the combination of the valve unit 108 and valve actuating unit 110 of the embodiment shown in FIG. 4 is essentially similar in effect to its counterpart in the embodiment of FIG. 1 and, for this reason, there is developed in the fluid outlet port 120 of the valve unit 108 a fluid pressure P*n* which varies in each of the picking cycles of the weft inserting arrangement in such a manner as indicated by the ramp A–C in the graph of FIG. 2. When the fluid thus directed into the fluid outlet port 120 of the valve unit 108 is passed through the second flow restriction unit 32' provided between the valve unit 108 and the fluid discharge nozzle 22, the flow of the fluid having the pressure P*n* is restricted by means of the orifice 46' in the disc member 44' of the unit 108 so that the fluid pressure P*n* upstream of the orifice 46' is modified into a fluid pressure P*n'* varying in such a manner as is indicated by ramp A'–C' in the graph of FIG. 5. The modified fluid pressure P*n'* has a component P*a'* resulting from the fluid pressure P*a* delivered from the accumulating chamber 66 of the pressure accumulator unit 34 and a component P*r'* resulting from the fluid pressure P*r* delivered from the first flow restriction unit 32 when the fluid pressure P*a* is being discharged from the pressure accumulating chamber 66. Point B' in FIG. 5 indicates the fluid pressure P*a'* obtaining in the pressure accumulating chamber 66 at the end of the picking cycle ending at time $t_2$.

Figure 5:
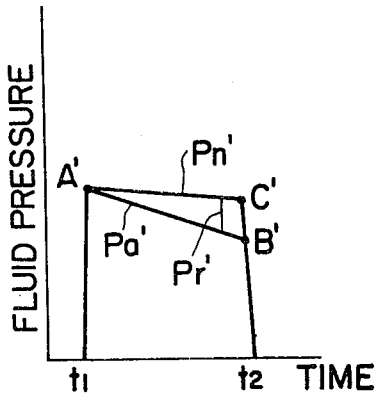
FIG. 5 is a graph showing a general tendency of the performance characteristic of the device shown in FIG. 4; and FIGS. *6a* to *6f* are graphs which indicate examples of the variation in the fluid pressure achieved in the device illustrated in FIG. 4 in each of picking cycles.

As will be seen from comparison between the graphs of FIGS. 2 and 5, the modified fluid pressure P*n'* is not only lower than the initial fluid pressure P*n* but decreases as the time lapses from $t_1$ to $t_2$ at a rate which is lower than the rate of decrease of the fluid pressure P*n*. The magnitude and the rate of decrease of the modified fluid pressure P*n'* may be selected by varying the cross sectional area of the orifice 46' in the disc member 44' relative to the cross sectional areas of the passageways 124' and 54' in the tubular members 122 and 52', respectively.

FIGS. 6*a* to 6*f* illustrate curves *a* to *f* indicative of the variation of the fluid pressure P*n'* developed in the fluid discharge nozzle 22 when the fluid fed into the branch pipe 30 is pressurized to 40 kgs/cm$^2$ and the pressure accumulator unit 34 is so designed as to have a pressure accumulating chamber 66 with a total capacity of 100 m*l* and fitted with a bag 68 filled with 10 kgs/cm$^2$ of gas and when the diameter *d* of the orifice 46 in the first flow restriction unit 32 is fixed at 3 mm and the diameter *d'* of the orifice 46' in the second flow restriction unit 32' is changed among 2.0, 2.4, 3.0, 4.0, 5.0 and 6.0 mm, respectively. From the curves *a* to *f* of FIGS. 6*a* to 6*f* it will be seen that the smaller the diameter of the orifice 46' of the second flow restriction the lower the fluid pressure P*n'* developed in the fluid discharge nozzle 22 and the smaller the difference between the levels of the fluid pressure P*n'* at the incipient and final stages of the picking cycle. Furthermore, the curves *a* to *f*, particularly, the curves *a* and *b* show that, if the diameter of the orifice 46 in the first flow restriction unit 32 is larger than the diameter of the orifice 46' in the second flow restriction unit 32', then the difference between the levels of the fluid pressures P*n'* developed in the fluid discharge nozzle 22 becomes so small that the weft yarn entrained on a jet stream produced by such a fluid pressure may fail to be properly picked. It is, for this reason, preferable that the orifice 46 in the first flow restriction unit 32 has a cross sectional area equal to or smaller than the cross sectional area of the orifice 46' in the second flow restriction unit 32'. The first and second flow restriction units 32 and 32' have thus far been described as shown as using the orifices having fixed working areas, each of the units may be replaced with a flow restriction unit having an adjustable working area using, for example, a throttle valve so that the magnitude of the fluid pressure delivered from the unit may be continuously varied depending upon the nature of the weft yarn used and/or the width of a woven fabric to be produced.

What is claimed is:

1. In a shuttleless weaving-loom with a weft inserting arrangement in which a weft yarn is picked into a weaving shed of warp yarns in predetermined cycles by a jet stream of liquid shot into the shed, a device for producing a jet stream comprising, liquid supply means for continuously supplying liquid under pressure at a constant rate, a liquid discharge nozzle disposed for discharging a jet stream of liquid shot into a shed of warp yarns for picking a weft yarn therewith, means defining a passageway interconnecting the fluid supply means and the fluid discharge nozzle, valve means disposed in the passageway and having means operative to a first position for providing communication between the fluid supply means and the fluid discharge nozzle and a second position for blocking the communication therebetween, control means for actuating the valve means into the first or second position thereof in cycles synchronized with the predetermined picking cycles of the weft yarn, pressure accumulating means disposed in the passageway upstream of the valve means for accumulating therein the pressure of the liquid from the liquid supply means when the valve means is in the second position thereof and delivering the accumulated liquid pressure to the liquid discharge nozzle through the valve means when the valve means is in the first conditioning thereof, first flow restriction means disposed in the passageway upstream of the pressure accumulating means for restricting the flow of the fluid from the liquid supply means to the pressure accumulating means, and second flow restriction means disposed in said passageway between said valve means and said nozzle for restricting the flow of the liquid from the valve means to the nozzle when the valve means is in said first position thereof.

2. A device for producing a jet stream as set forth in claim 1, in which said control means comprises electromagnetic actuating means mechanically connected to said valve means and energized in cycles synchronized with the picking cycles of the weft inserting arrangement for actuating the valve means into the first position thereof in said cycles, and resilient biasing means constantly biasing said valve means toward said second position thereof so that the valve means is actuated to the second position thereof when said electromagnetic actuating means is de-energized.

3. A device for producing a jet stream as set forth in claim 1, in which said control means comprises a rotary cam member rotatable at a velocity corresponding to the picking cycles of the weft, cam follower means engaging said cam member and said valve means for being intermittently driven by said cam member into a position operative to move the valve means into said first position thereof in cycles synchronized with the picking cycles, and resilient biasing means biasing the cam follower means toward a position operative to move the valve means into the second position thereof.

4. A device as set forth in claim 1, in which said first flow restriction means and second flow restriction means each have respective working cross section areas, wherein the working cross section area of said first flow restriction means is equal or smaller than the working cross section area of said second flow restriction means.

5. A device as set forth in claim 1, in which said second flow restriction means has a fixed working cross section area.

6. A device as set forth in claim 5, in which said second flow restriction means comprises means removable from said passageway.

7. A device as set forth in claim 5, in which said second flow restriction means comprises means defining an adjustable working cross section area.

8. A device as set forth in claim 5, in which said second flow restriction means comprises means defining an adjustable working area.

9. A device as set forth in claim 8, in which said second flow restriction means comprises a throttle valve having said adjustable working cross section area.

10. A device as set forth in claim 1, in which each of said first flow restriction means and second flow restriction means comprises a throttle valve having said adjustable working cross section area.

11. A device as set forth in claim 10, in which each of said first and second flow restriction means comprises means removable from said passageway.

12. A device as set forth in claim 10, in which each of said first and second flow restriction means has an orifice having said fixed working cross section area.

13. A device as set forth in claim 1, in which each of said first flow restriction means and said second flow restriction means comprises means defining an adjustable working cross section area.

14. A device as set forth in claim 13, in which said first and second flow restriction means each comprises a throttle valve having said adjustable working cross section area.

15. A device as set forth in claim 1, in which said pressure accumulating means comprises a hydropnuematically operated means.

16. A device as set forth in claim 15, in which the hydropnuematically operated pressure accumulating means comprises a pressure accumulating chamber communicating with said passageway between said flow restriction means and said valve means and a flexible confinement positioned within said pressure accumulating chamber and filled with a compressible gas under pressure.

* * * * *